United States Patent [19]

Knotts

[11] Patent Number: 5,044,990

[45] Date of Patent: Sep. 3, 1991

[54] RF COAXIAL CONNECTOR

[75] Inventor: William D. Knotts, New Albany, Ohio

[73] Assignee: AT&T Bell Laboratories, Murray Hill, N.J.

[21] Appl. No.: 546,285

[22] Filed: Jun. 29, 1990

[51] Int. Cl.[5] ..... H01R 9/05

[52] U.S. Cl. ..... 439/578; 439/63

[58] Field of Search ..... 439/63, 578, 579, 580, 439/581, 582, 583, 584, 585, 675

[56] References Cited

U.S. PATENT DOCUMENTS

| | | | |
|---|---|---|---|
| 4,326,769 | 4/1982 | Dorsey et al. | 439/578 X |
| 4,619,496 | 10/1986 | Forney, Jr. et al. | 439/675 X |
| 4,687,279 | 8/1987 | Holland et al. | 439/578 |
| 4,740,172 | 4/1988 | Tubbs | 439/344 |
| 4,917,630 | 4/1990 | Hubbard | 439/578 |
| 4,917,631 | 4/1990 | Souders et al. | 439/583 |

*Primary Examiner*—Neil Abrams
*Assistant Examiner*—Khiem Nguyen
*Attorney, Agent, or Firm*—D. A. Marshall

[57] ABSTRACT

A connector assembly for interconnecting conventional RF equipment with a connector having a cylindrical ground conductor with a signal conductor male member insulated from and extending outward from the cylindrical ground conductor. The assembly comprises a cylindrical member having a cavity formed with an electrically insulated signal conductor female member positioned therein to extend along an axis of the cylindrical member for engaging the signal conductor male member. An adaptor having a tubular section sized for insertion into the cylindrical member cavity receives the cylindrical ground conductor with the signal conductor male member in electrical engagement with the signal conductor female member. The adapter is formed with an annular section abutted the tubular section that supports the tubular section within the cylindrical member cavity in electrical engagement therewith and has a projecting member formed thereon for use with a cap to secure the adaptor within the cylindrical member cavity.

11 Claims, 2 Drawing Sheets

RF COAXIAL CONNECTOR

TECHNICAL FIELD

The invention relates to connector apparatus and in particular to a connector assembly for use in interconnecting radio frequency equipment.

BACKGROUND AND PROBLEM

Radio frequency equipment oftentimes has devices that require the use of connectors to interconnect components of the equipment. Such types of connectors are referred to as RF connectors and function to interconnect coaxial cables, coaxial cables with components or components with other components. In one such example, a component, such as a circuit board, may be interconnected with an RF device in order that communication facilities located on the circuit board may be interconnected with RF channels provided by the RF device.

Such a circuit board may have a connector typically consisting of a base portion constructed of an electrically conducting material and which is positioned on the circuit board and coupled to the circuit board ground circuitry. The base portion extends outward from the circuit board into a cylindrical member which forms the ground conductor of the connector. An elongated male member is positioned within the cylindrical ground conductor along a center line thereof and insulated therefrom to extend outward from the cylindrical ground conductor to form the connector signal conductor. In operation, the circuit board is inserted into an equipment mounting such that the connector signal conductor male member extends into an opening of a RF device to engage signal circuitry of the RF device. The cylindrical ground conductor is also engaged with the RF device to provide ground for the coaxial connection.

A problem arises in that this type of connector design prevents conventional RF devices from being interconnected with the circuit board thereby severely restricting the design of RF devices that may be used with circuit boards of the RF equipment.

SOLUTION

The foregoing problem is solved by an assembly arranged to engage a connector having a cylindrical ground conductor with an elongated signal conductor male member extending outward from the cylindrical ground conductor and insulated therefrom. The assembly comprises a cylindrical member having a cavity formed at one end along a longitudinal axis thereof. A signal conductor female member for engaging the elongated signal conductor male member is positioned within the cavity to extend along the cylindrical member axis and is electrically insulated from the cylindrical member. The connector also comprises an adaptor having a tubular member formed with an inner duct for receiving the cylindrical ground conductor with the elongated signal conductor male member maintained in electrical engagement with the cylindrical member signal conductor female member. The adaptor tubular member has an outer dimension sized for insertion into the cylindrical member cavity with sides of the cavity in electrical engagement with the tubular member. The adaptor is formed with an annular section or member abutted an end of the tubular member for supporting the tubular member within the cavity in electrical engagement with the cylinder member. A projecting section or member is formed on a top surface of the annular member thereby enabling the adaptor to be secured within the cavity of the cylindrical member.

DETAILED DESCRIPTION

Figure 2:
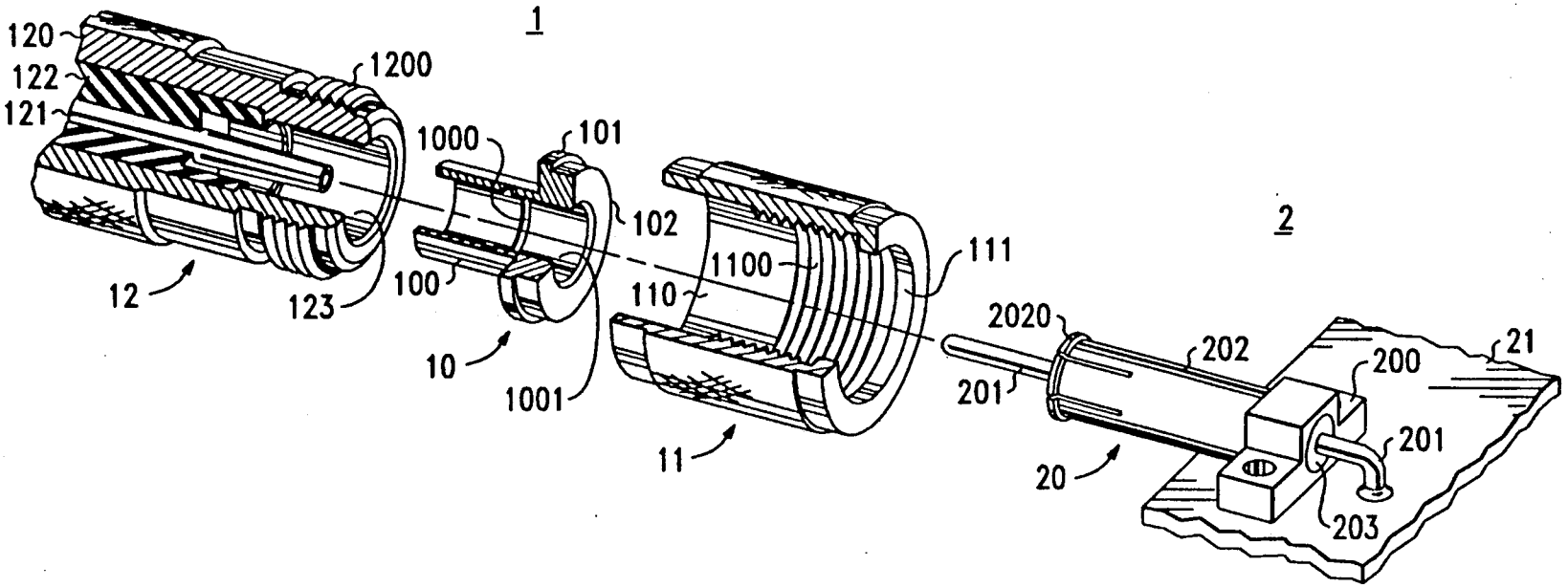
FIG. 2 illustrates an exploded view of the component parts of the connector assembly set forth in FIG. 1.

In an exemplary embodiment of the invention, FIG. 2, apparatus 2 has a circuit board 21 with a male RF connector 20 mounted thereon that is intended for use in interconnecting circuit board 21 with an RF device. RF connector 20 consists of a base portion 200 constructed of an electrically conducting material, such as copper or a copper alloy, and which is positioned on circuit board 21 and coupled to ground circuitry positioned thereon. Base portion 200 extends outward from circuit board 21 into a cylindrical ground conductor 202 which forms the ground conductor of RF connector 20. An elongated male member 201, positioned within cylindrical ground conductor 202 along a center line thereof, is surrounded by insulation 203 such that elongated male member 201 is electrically insulated from cylindrical ground conductor 202. Male member 201 extends outward from cylindrical ground conductor 202 to form the signal conductor of RF connector 20. Thus, RF connector 20 enables a coaxial connection to be made with RF circuitry of circuit board 21.

Connector assembly 1 comprises apparatus 12 consisting of a cylindrical member 120 having cavity 123 formed at one end along a longitudinal center axis of cylindrical member 120. A signal conductor female member 121 is positioned within cavity 123 of cylindrical member 120 to extend along the longitudinal axis and is electrically insulated by surrounding insulating material 122 from cylindrical member 120. Signal conductor female member 121 has an open end intended for use in receiving signal conductor male member 201 of RF connector 20.

Adaptor 10 is provided for use with connector assembly 1 and is formed of an electrical conducting material, such as the aforementioned copper or copper alloy. A tubular member 100 of adaptor 10, FIG. 1, has an inner duct 1001 configured for receiving and electrically engaging cylindrical ground conductor 202 of RF connector 20 such that elongated signal conductor male member 201 is inserted into and in electrical engagement with signal conductor female member 121. Annular recess 1000, FIG. 2, is formed on a surface of inner duct 1001 and serves to engage lip section 2020 of cylindrical member 202 thereby insuring that cylindrical member 202 and elongated signal conductor male member 201 of RF connector 20 are in engagement with adaptor 10 and signal conductor female member 121, respectively, of apparatus 12. The outer dimension of tubular member 100 is sized for insertion into cavity 123 of cylindrical member 120 with the sides of cavity 123 in electrical engagement with the outer dimensions of tubular member 100. Adaptor 10 is formed with an annular section or member 101 mounted upon or abutted an end of tubular member 100 and serves to support adaptor 10, FIG. 1, such that tubular member 100 is positioned within cavity 123 in electrical engagement with cylinder member 120. Projecting member 102 is formed on a top surface of annular member 101 for use in securing adaptor 10 to cylindrical member 120.

Cylindrical member 120, FIG. 2, may be provided with a thread section 1200 formed on an outer surface of the adaptor receiving end thereof which is matched to receive a similar thread section 1100 formed on an inner surface of a cap member recess 110. Cap member 11 is intended to engage apparatus 12, FIG. 1, for the purpose of securing adaptor 10 to cylindrical member 120. Cap member recess 110, FIG. 2, is sized to fit over and receive the adaptor receiving end of cylindrical member 120 and threaded thereon by engaging thread section 1100 with corresponding thread section 1200. Overlap section 111 is formed on an end of cap member 11 opposite threaded section 1100 and is of such a diameter sized to receive projecting member 102 of adaptor 10. Although apparatus 12 is set forth in FIGS. 1 and 2 as having a generally cylindrical outer configuration, it is to be understood that other types of configurations are also within the teaching of the invention. For example, apparatus 12 could be of a generally outer rectangular configuration having circular cavity 123 located therein with signal conductor female member 121 formed to extend perpendicularly from a bottom surface of cavity 123 along an axis parallel to sides of cavity 123. Such a rectangular structure may be provided with a conventional latch structure for securing cap 11 thereto or may receive cap 11 in an interference fit thereby enabling cap 11 to secure adaptor 10 to apparatus 12 with tubular member 100 in electrical engagement with sides of cavity 123. Similarly, cap 11 could be formed with a generally rectangular configuration sized to receive the adaptor end of apparatus 12. Such a configured cap could have an overlap section 111 sized to receive a similarly configured projecting member 102 of adaptor 10 so that adaptor 10 may be secured to apparatus 12.

In assembly, tubular member 100, FIG. 2, of adaptor 10 is inserted into cavity 123 to fit over signal conductor female member 121 until the under surface of annular member 101 is positioned upon an end surface of cylindrical member 120. Cap 11, FIG. 1, is then positioned on the end of cylindrical member 120 and threaded to secure adaptor 10 to cylindrical member 120 so that adaptor projecting member 102 extends into and through the opening of the cap overlap section 111 thereby securing tubular member 100 of adaptor 10 within cavity 123.

RF connector 20 is connected with connector assembly 1 by inserting elongated signal conductor male member 201 into the opening of adaptor 10 positioned within cylindrical member 120. As signal conductor male member 201 is further inserted into adaptor 10, lip section 2020 is slightly compressed and engaged by the sides of adaptor duct 1001. This results in the alignment of the end of signal conductor male member 201 with signal conductor female member 121. The continued insertion of RF connector 20 into adaptor 10 of connector assembly 1 results in the entry of the end of signal conductor male member 201 into the end of signal conductor female member 121. Lip section 2020 is received by annular recess 1000 and expands to engage the sides thereof to insure the insertion of signal conductor male member 201 into signal conductor female member 121 and the engagement of cylindrical ground conductor 202 with the sides of adaptor duct 1001.

Figure 1:
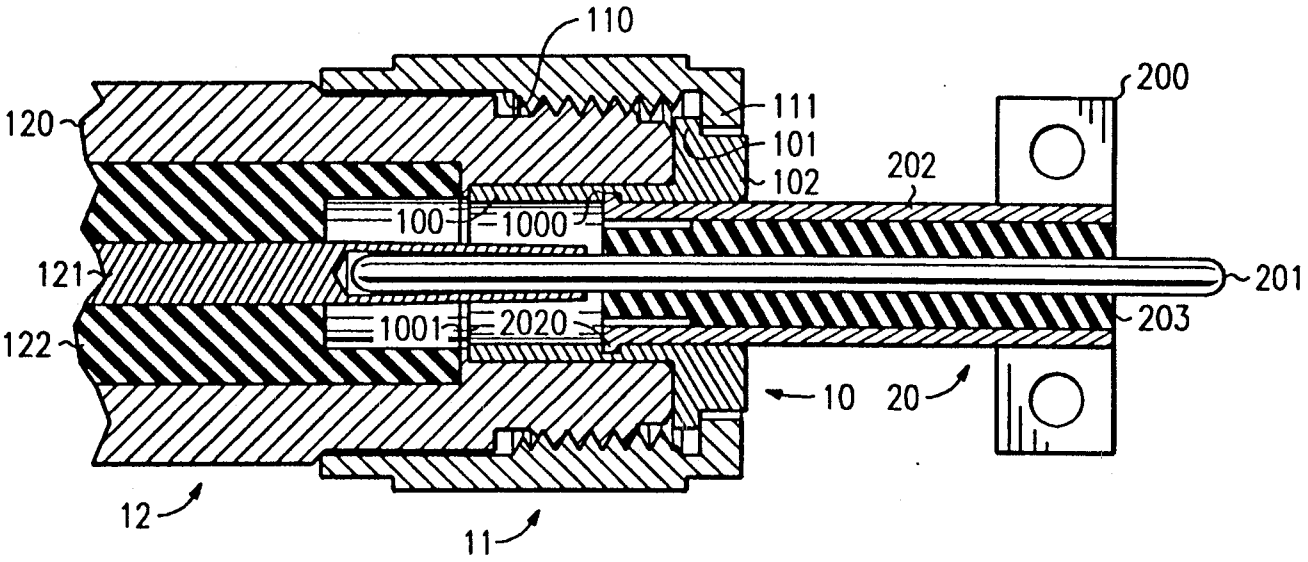
FIG. 1 illustrates an assembled view of a connector assembly having novel structural features in accordance with the principles of the invention.

The interconnected connectors 1, 2, FIG. 1, provide an RF coaxial connection between the circuitry of circuit board 21, FIG. 2, and an RF device that may be coupled with connector 1. The completed RF coaxial connection comprises a shielded signal path that extends from the RF equipment coupled with connector assembly 1 through signal conductor female member 121 and engaged signal conductor male member 201 to the circuitry of circuit board 21, FIG. 2, coupled with signal conductor male member 201. The signal path is shielded by ground applied to cylindrical member 120 by ground circuitry of the RF device coupled with connector 1 and by the ground circuitry of circuit board 21 coupled with base 200 of RF connector 20. The connection ground path, FIG. 1, is completed by the engagement of cylindrical member 202 with the sides and annular recess 1000 of duct 1001 of adaptor 10 and with the engagement of the outer surface of adaptor tubular member 100 and annular member 101 with cylindrical member 120. The coaxial connection may be broken by extracting cylindrical member 202 and signal conductor male member 201 from connector assembly 1.

Annular section 101 and projecting member 102 may be positioned on tubular member 100 such that an end of tubular member 100 extends outward from overlap section 111 of cap member 11 to aid in the alignment of elongated signal conductor male member 201 with signal conductor female member 121.

I claim:

1. An assembly for engaging a connector having a cylindrical ground conductor formed of electrical conducting material with an elongated signal conductor member extending outward from the cylindrical ground conductor and insulated therefrom, said assembly comprising means having apparatus formed of said electrical conducting material with a cavity formed therein along a longitudinal axis of said apparatus and with another signal conductor member positioned along said axis within said apparatus and electrically insulated therefrom for engaging the elongated signal conductor member, and adaptor means having a tubular member with an inner duct for receiving and compressing the cylindrical ground conductor and having an annular recess formed in said inner duct for engaging said compressed ground conductor and enabling said compressed ground conductor to expand to engage said duct and with the elongated signal conductor member in electrical engagement with said other signal conductor member and wherein said tubular member is sized for insertion into said cavity with sides of said cavity in electrical engagement with said tubular member and wherein said tubular member is formed with a member abutted an end of said tubular member for supporting said tubular member within said cavity in electrical engagement with said apparatus.

2. The connector engaging assembly set forth in claim 1 further comprising means for securing said abutted member of said tubular member to said engaging means with said tubular member positioned within said engaging means cavity.

3. The connector engaging assembly set forth in claim 2 wherein said tubular member comprises an annular recess formed on a surface of the tubular member inner duct and positioned therein for engaging an end of the cylindrical ground conductor thereby insuring that the cylindrical ground conductor and the elongated signal conductor member are in electrical engagement with said tubular member and said other signal conductor member, respectively, when said tubular member is secured within the cavity.

4. The connector engaging assembly set forth in claim 3 wherein said engaging means comprises a cylindrical configured member formed of said electrical conducting material with a cavity formed therein along a longitudinal axis of said cylindrical configured member with a signal conductor female member positioned along said cylindrical configured member axis within said cavity and electrically insulated from said cylindrical configured member for engaging the elongated signal conductor member.

5. The connector engaging assembly set forth in claim 4 wherein said adaptor means comprises an adaptor having a tubular member sized for insertion into said cylindrical configured member cavity with sides of said cavity in electrical engagement therewith and having an inner duct formed in said adaptor tubular member along a longitudinal axis thereof for receiving the connector cylindrical ground conductor with the elongated signal conductor member in electrical engagement with said signal conductor female member and wherein said adaptor is formed with a member abutted an end of said tubular member for supporting said tubular member within said cavity in electrical engagement with said cylindrical configured member and having a projecting member formed on said abutted member opposite said tubular member for use with said securing means to secure said adaptor to said cylindrical configured member.

6. The connector engaging assembly set forth in claim 5 wherein said cylindrical configured member has a thread section formed on an outer surface of said adaptor receiving cavity for receiving said securing means, and wherein said securing means is a cylindrical configured cap having a threaded cavity sized to fit over and receive said adaptor receiving cavity by engaging said thread section thereof and having an overlap section formed on an end opposite said threaded cavity with an opening of such a diameter to receive said adaptor projecting member to secure said adaptor to said cylindrical configured member.

7. A connector assembly for engaging a male connector assembly having a cylindrical ground conductor with a signal conductor male member extending outward from the cylindrical ground conductor and insulated therefrom, said assembly comprising a cylindrical member having a cavity formed at one end along a longitudinal axis of said cylindrical member with a signal conductor female member positioned therein along said axis and electrically insulated from said cylindrical member for engaging the signal conductor male member, and adaptor means having a tubular member with an inner duct for receiving and compressing an end of the cylindrical ground conductor and having an annular recess formed in said inner duct for engaging said end of said compressed ground conductor and enabling said compressed ground conductor to expand to engage said inner duct and with the signal conductor male member in electrical engagement with said signal conductor female member and wherein said tubular member is sized for insertion into said cavity with sides of said cavity in electrical engagement with said tubular member and wherein said adaptor means is formed with an annular member abutted an end of said tubular member for supporting said tubular member within said cavity in electrical engagement with said cylinder member and having a projecting member formed on said annular member for securing said adaptor means to said cylindrical member.

8. An assembly for engaging a connector having a cylindrical ground conductor formed of electrical conducting material with a signal conductor male member extending outward from the cylindrical ground conductor and insulated therefrom, said assembly comprising a cylindrical configured member formed of the electrical conducting material and having a thread section formed on an outer surface of one end with a cavity formed at said one end along a longitudinal axis of said cylindrical configured member with a signal conductor female member positioned along said axis within said cavity and electrically insulated from said cylindrical configured member for engaging the connector signal conductor male member, an adaptor having a tubular section sized for insertion into said cavity with sides of said cavity in electrical engagement therewith and having an inner duct formed in said tubular section along said axis for receiving the connector cylindrical ground conductor with the signal conductor male member in electrical engagement with said signal conductor female member and wherein said adaptor is formed with a circular configured section abutted an end of said tubular section for supporting said tubular section within said cavity in electrical engagement with said cylindrical configured member and having a projecting section formed on said circular configured section opposite said tubular member for use in securing said adaptor to said cylindrical configured member, a cylindrical configured cap having a threaded cavity sized to fit over and receive said cylindrical configured member adaptor receiving cavity end by engaging said thread section and having an overlap section formed on an end opposite said threaded cavity with an opening of such a diameter to receive said adaptor projecting section to secure said adaptor to said cylindrical configured member, and an annular recess formed on a surface of said tubular section inner duct and positioned therein for engaging a shaped end of the connector cylindrical ground conductor thereby insuring that the connector cylindrical ground conductor and extended signal male conductor are in electrical engagement with said tubular section and said signal conductor female member, respectively, when said tubular section is secured within said cavity.

9. An adaptor for use with a coaxial connector having a cylindrical member with a cavity formed therein along a longitudinal axis and with a signal conductor member electrically insulated from the cylindrical member and positioned within the cavity along the axis to enable engagement of the coaxial connector with a connector having a cylindrical ground conductor with another signal conductor member extending outward from the cylindrical ground conductor and insulated therefrom, said adaptor comprising a tubular section sized for insertion into the cylindrical member cavity with sides of the cavity in electrical engagement therewith and having an inner duct formed in said tubular section along a longitudinal axis thereof for receiving and compressing an end of the connector cylindrical ground conductor and having an annular recess formed in said inner duct for engaging said end of said compressed ground conductor and enabling said compressed ground conductor to expand to engage said inner duct and with the other signal condutor member in electrical engagement with the signal conductor member and wherein said adaptor is formed with a circular configured section abutted one end of said tubular section for supporting said tubular section within the cylindrical member cavity in electrical engagement with the cylindrical member and having a projecting section formed on said circular configured section opposite said tubular section for use in securing said adaptor to said cylindrical member.

10. The connector adaptor set forth in claim 9 wherein said tubular section comprises said annular recess formed on a surface of said tubular section inner duct and positioned therein for engaging an end of the cylindrical ground conductor thereby insuring that the cylinder ground conductor and the other signal conductor are in electrical engagement with said tubular section and said other signal conductor member, respectively, when said tubular section is secured within the cylindrical member cavity.

11. A connector assembly comprising in combination a first member having a cylindrical ground conductor formed of electrical conducting material with a signal conductor male member extending outward from said cylindrical ground conductor and insulated therefrom, a second member having a cylindrical configured member formed of said electrical conducting material and having a thread section formed on an outer surface of one end with a cavity formed at said one end along a longitudinal axis of said cylindrical configured member with a signal conductor female member positioned along said axis within said cavity and electrically insulated from said cylindrical configured member, an adaptor having a tubular section sized for insertion into said cylindrical configured member cavity of said second member with sides of said cavity in electrical engagement therewith and having an inner duct formed in said tubular section along a longitudinal axis of said adaptor for receiving said first member cylindrical ground conductor with said signal conductor male member in electrical engagement with said signal conductor female member and wherein said adaptor is formed with a circular configured section abutted an end of said tubular section for supporting said tubular section within said cylindrical configured member cavity in electrical engagement with said cylindrical configured member and having a projecting section formed on said circular configured section opposite said tubular section for use in securing said adaptor to said cylindrical configured member, a cylindrical configured cap having a threaded cavity sized to fit over and receive said second member by engaging said thread section thereof and having an overlap section formed on an end opposite said threaded cavity with an opening of such a diameter to receive said adaptor projecting section to secure said adaptor to said cylindrical configured member, and an annular recess formed on a surface of said tubular section inner duct and positioned thereon for engaging said cylindrical ground conductor thereby insuring that said cylindrical ground conductor and said extended signal male conductor are in electrical engagement with said tubular section and said signal female conductor, respectively, when said adaptor is secured within said cylindrical configured member cavity.

* * * * *